US011647326B2

(12) United States Patent
Oclee-Brown et al.

(10) Patent No.: US 11,647,326 B2
(45) Date of Patent: May 9, 2023

(54) LOUDSPEAKERS

(71) Applicant: GP Acoustics International Limited, Kwai Chung (HK)

(72) Inventors: Jack Anthony Oclee-Brown, Staplehurst (GB); Sebastien Degraeve, Maidstone (GB)

(73) Assignee: GP ACOUSTICS INTERNATIONAL LIMITED, Kwai Chung (HK)

( * ) Notice: Subject to any disclaimer, the term of this patent is extended or adjusted under 35 U.S.C. 154(b) by 136 days.

(21) Appl. No.: 17/130,678

(22) Filed: Dec. 22, 2020

(65) Prior Publication Data

US 2021/0195316 A1 Jun. 24, 2021

(30) Foreign Application Priority Data

Dec. 23, 2019 (GB) ..... 1919144
Nov. 4, 2020 (GB) ..... 2017429

(51) Int. Cl.
*H04R 1/28* (2006.01)
*H04R 31/00* (2006.01)

(52) U.S. Cl.
CPC ..... *H04R 1/288* (2013.01); *H04R 31/00* (2013.01)

(58) Field of Classification Search
None
See application file for complete search history.

(56) References Cited

U.S. PATENT DOCUMENTS 2,293,181 A * 8/1942 Terman ..... G10K 11/16 181/166
10,032,445 B1 7/2018 Linch et al.
10,453,438 B1 * 10/2019 Griffin ..... G10K 11/17875
2014/0027201 A1 1/2014 Islam et al.
2016/0276992 A1 9/2016 Vilermo et al.
2018/0124501 A1 * 5/2018 Hosoi ..... H04R 1/30

FOREIGN PATENT DOCUMENTS

EP 0984662 A2 3/2000
EP 2040483 B1 9/2008
GB 547922 A 9/1942
GB 2290672 A 1/1996
GB 2324928 A 11/1998
WO 2018047153 A1 3/2018
WO WO-2020208380 A1 * 10/2020 ..... G10K 11/002

OTHER PUBLICATIONS

Search Report issued for GB1919144.4 dated May 5, 2020.

* cited by examiner

*Primary Examiner* — Walter F Briney, III
(74) *Attorney, Agent, or Firm* — Westman, Champlin & Koehler, P.A.; Z. Peter Sawicki; Amanda M. Prose

(57) ABSTRACT

A loudspeaker comprising: an acoustic diaphragm having front and rear surfaces, the acoustic diaphragm in use being driven so as to vibrate and radiate acoustic waves from its front surface in a forward direction away from the loudspeaker and from its rear surface in a rearward direction, and a drive unit located rearwardly or to the front/outside of the diaphragm, there being at least one open duct leading in a rearward direction away from the diaphragm, in which the at least one open duct has a cross-sectional area which decreases in the rearward direction, and in which acoustic waves radiated from the rear surface of the diaphragm pass through the open duct before contacting a front surface of an acoustic metamaterial absorber located generally behind the drive unit and immediately to the rear of the duct.

14 Claims, 3 Drawing Sheets

Prior Art

LOUDSPEAKERS

CROSS REFERENCE TO RELATED APPLICATION

This application claims priority to and benefits of GB Patent Application No. 1919144.4, filed Dec. 23, 2019 and GB Patent Application No. 2017429.8, filed Nov. 4, 2020, the content of which are hereby incorporated by reference in their entirety.

FIELD OF THE INVENTION

The present invention relates to loudspeakers.

BACKGROUND ART

The structure and operation of moving coil loudspeaker drive units is well known. A vibration diaphragm is attached to a coil of wire known as a voice coil, and the voice coil is placed in a magnetic field usually provided by one or more permanent magnets (together the voice coil and magnets being termed a motor or drive unit). When an alternating current is passed through the voice coil a force is induced in the voice coil, causing it to reciprocate and the diaphragm to vibrate and so to radiate acoustic waves. Acoustic waves are radiated from both sides of the diaphragm; the sound radiated from the front of the diaphragm is directed towards the listener, whereas the sound radiated from the rear of the diaphragm must be carefully treated if it is not to adversely affect the sound quality perceived by the user. In many cases, the loudspeaker is provided with an enclosure from which the front of the diaphragm projects, so that rear radiated sound is absorbed within the enclosure. For loudspeaker drivers operating in the midrange and high-frequency audio regions, from approximately 200 Hz to 20 kHz, the best possible scenario is that the rear radiated sound propagates totally unimpeded into the enclosure and is totally absorbed without reflection. This optimal situation would lead to the best possible sound quality with the driver free to operate without any influence from the enclosure.

A common approach to try and achieve this ideal is to provide an open duct directly behind the diaphragm, leading through or around the motor system, to allow the rear sound to propagate away from the loudspeaker diaphragm (as shown in our U.S. Pat. No. 5,548,657 for example). FIG. 1*a* shows a section view of a prior art high frequency tweeter 2*a* from a coaxial driver using this approach, in this case having a large vent tube or duct 4*a* leading through the motor, or drive unit, 6*a* away from the rear of the diaphragm 10 (in this case having a 25.4 mm diameter). The cross-sectional area of the duct 4*a* should be as large as possible for the rear sound to propagate unimpeded (the sound radiated from the front of the diaphragm 10 travels toward the direction of the listener, as shown by arrow A, which is parallel to the rear-front axis XX of the tweeter 2*a*, duct 4*a*, drive unit 6*a* and diaphragm 10). In order to absorb the rear sound and minimise reflection, the entire duct 4*a* is filled with an acoustically absorbent material 8, such as wadding or high density polyurethane foam. This simple approach has the advantage of allowing a relatively large volume rear enclosure, and this helps to reduce pressure behind the diaphragm 10 at low frequencies, but is quite poor at attenuating rear reflection and the example in FIG. 1*a* reflects around 40% of the rear sound at 2 kHz.

U.S. Pat. No. 2,293,181A describes a loudspeaker that attempts to achieve the above ideal using an exponentially tapering duct filled with lightweight porous wadding material. This style of midrange and high-frequency loudspeaker enclosure is now in wide use in high-quality loudspeakers. However, in order to achieve low reflection over a wide bandwidth the tapered duct must be long. In addition, the volume of air in the duct is smaller than the simpler arrangement of FIG. 1*a* and this leads to a higher rear pressure at low frequencies, impeding the free movement of the diaphragm. FIG. 1*b* shows a section through such a known high-frequency driver 2*b* from another coaxial driver (with a 25.4 mm diameter diaphragm 10 and again having a rear-front axis XX) using a 120 mm long exponentially tapering duct 4*b* leading through the drive unit 6*b* to the rear enclosure. In use this duct 4*b* is again filled with a porous absorbent material 8, such as polyester fibre. A design such as this reflects approximately 30%, or −10 dB, of the rear radiated sound at 2 kHz, and is therefore an improvement over the design in FIG. 1*a* in acoustic terms, but is significantly larger (particularly in depth, along the XX axis) than the FIG. 1*a* design.

There is a continuing need to provide loudspeakers which absorb rather than reflect a significant proportion of the rear radiated sound, whilst maintaining a small overall size.

SUMMARY OF THE INVENTION

The present invention is predicated on using acoustic metamaterials as the absorbing material, and on incorporating such materials in a design specifically tailored to reduce reflection of rear radiated sound in a small overall volume. A metamaterial is a material engineered to have a property that is not found in naturally occurring materials, in the present invention an acoustic metamaterial is a man-made material which has superior damping or vibro-acoustic characteristics compared to conventional damping materials. These improved characteristics comprise damping or absorbing sound or pressure to a greater extent than conventional absorbers, and/or over a greater variety or range of frequencies; these improved properties are often due to the structure of the metamaterial rather than its material composition. Such structural metamaterials are made from assemblies of multiple elements fashioned from composite materials such as metals and plastics. The materials are often arranged in repeating patterns, and are at a scale that is smaller than the wavelengths of the phenomena they influence; in the present invention, acoustic wavelengths across the usual audible frequency range, between about 20 Hz and 20 kHz. The precise shape, geometry, size, orientation and arrangement of the elements of acoustic metamaterials gives them their smart properties, capable of manipulating acoustic waves by blocking, absorbing, enhancing, or bending the waves. Structural acoustic metamaterials are known, for example from US 2014/0027201 and WO 2018/047153. Metamaterial absorbers offer much higher absorption at comparable sizes to conventional absorbers, such as the tapered tube. For example the devices outlined in WO 2018/047153 have a length of about 11 cm, and reflect (approximately) only 2% of the incident sound at 2 kHz. Other, non-structural metamaterials comprise a plurality of active and/or mechanical components, such as a number of MEMs (Micro-Electro-Mechanical systems) diaphragms each with tuned mass, stiffness and mechanical resistance, and such non-structural metamaterials provide an acoustic absorption of specific impedance. The present invention is not limited to structural metamaterials, but instead may be carried out using any kind of metamaterial.

A metamaterial absorber is typically composed of a number of narrow acoustical channels of various different lengths, shapes, orientations and/or cross-sectional areas. The metamaterial absorbent surface is formed by closely spaced walls forming ducts, or channels as we will refer to them here. These channels are usually sufficiently narrow for viscous effects of the air to dissipate acoustic energy. Often (as in WO2018047153A1) these channels are folded to create a compact overall structure. In most cases a significant portion of the acoustical dissipation comes from air viscosity in these narrow channels, and therefore it is important that the channels are extremely narrow to attain optimum results. The manufacture of such an arrangement is complicated. In addition, the structural walls that form the channels through the metamaterial occupy volume and, in some arrangements, this can reduce the effectiveness of the absorber. A straightforward approach to improving existing designs would be to incorporate a metamaterial into a loudspeaker, by placing the metamaterial directly behind the diaphragm (e.g. so as to replace the material 8 shown in FIGS. 1*a* and 1*b* with the same physical arrangement of metamaterial). The benefit of this approach is that the acoustical behaviour of the enclosure can be almost entirely dictated by the metamaterial. However, as can be appreciated from FIGS. 1*a* and 1*b* the space directly behind the diaphragm 10 is limited by the dimensions of the duct 4*a*, 4*b*, which are determined by the design of the drive unit 6*a*, 6*b*. This makes the design and manufacture of the metamaterial much more challenging due to practical limitations on minimum metamaterial wall thickness. In particular, since the structural walls of the metamaterial occupy volume and thus a proportion of the cross-sectional area of the duct 4*a*, 4*b*, this severely limits the effective open area that the metamaterial presents to the rear radiated sound, and consequently the path of the rear sound wave is significantly impeded. This issue is particularly severe if, in order to increase the viscous losses, extremely narrow metamaterial channels are used—because more channels require more walls, which take up a greater proportion of the cross-sectional area of the rearward-leading duct. In the above-described examples there is an assumption that the metamaterial is arranged with the narrow channels primarily arranged parallel to the rear-front, propagation axis of the open duct; there is insufficient room within the duct for the narrow channels to deviate very much from this axial direction.

The present invention therefore provides a loudspeaker comprising: an acoustic diaphragm having front and rear surfaces, the acoustic diaphragm in use being driven so as to vibrate and radiate acoustic waves from its front surface in a forward direction away from the loudspeaker and from its rear surface in a rearward direction, a drive unit, and at least one open duct leading through the drive unit in a rearward direction away from the diaphragm and having an opening at its rearward end, in which the at least one open duct has a cross-sectional area extending in the rearward direction, in which the cross-sectional area tapers or decreases along at least part of the rearward direction, and in which acoustic waves radiated from the rear surface of the diaphragm pass through substantially all of the open duct before contacting a front surface of an acoustic metamaterial absorber located generally outside and immediately to the rear of the duct, and to the rear of the decreasing cross-sectional area.

In such arrangements, the rear sound is channelled from the diaphragm to the metamaterial through a large area and low impedance duct with minimal or no porous acoustic wadding. This arrangement is very effective at allowing the majority of the rear-radiated sound to propagate to the metamaterial absorber, which in turn can be located further away from the diaphragm in an area where space is available, thereby allowing much more freedom over the metamaterial design and mechanical construction. There is also a subtlety to this arrangement that is not obvious on first examination. Although the metamaterial absorber can be designed to have extremely low reflection, this arrangement makes the effect of even a small reflection by the metamaterial much more problematic. Any reflection from the metamaterial will now occur at the interface between the duct and the metamaterial, the front surface of the metamaterial, which is now a significant rearward distance away from the diaphragm. The propagation time for the rear-sound to travel down the duct to the interface and back to the diaphragm is typically several periods of the upper frequency range of the driver. This effect introduces irregularities into the driver diaphragm movement due to the reflective wave impinging on the diaphragm, and these irregularities can be severe even if the reflection from the metamaterial is a small percentage of the incident sound arriving at the metamaterial. It is therefore absolutely key to minimise any reflection from the front surface of the metamaterial at the interface between the duct and the metamaterial absorber. A significant proportion of the absorbent surface is formed by the walls separating adjacent channels, but these walls decrease the 'opening area' of the channels making it smaller than the 'opening area' of the driver duct* resulting in reflections. By aligning the channels with a surface normal or at an angle to the 'driver duct' aperture the total cross-sectional area of the channel apertures may be made to match the duct area, thereby greatly reducing reflections due to the wall thickness. (*The duct 'opening area' is the "long-wavelength wavefront area' within an infinitely extending duct at the position of the opening). It is not always the case, however, that the metamaterial effective open area should match the duct open area. To get the best impedance match it is sometimes helpful to have a slight mismatch in the physical areas (to compensate for different acoustic materials or for viscosity in the meta-material).

In order to avoid acoustic reflection, the characteristic impedance of the wave travelling in the duct must match the acoustic impedance of the metamaterial absorber. Any fully enclosed and finite size acoustical absorber, including a metamaterial absorber, has zero absorption at very low frequencies. From this it follows that the real part of the acoustic impedance of the absorber will also be zero at very low frequencies. In addition, any fully enclosed, finite size acoustic absorber will have a low frequency impedance that has a negative imaginary part due to the acoustical compliance of the enclosed volume. A duct with constant cross-section, as shown in FIG. 1*a*, carries a plane acoustical wave with a characteristic impedance that has zero imaginary part and a constant real part. Consequently a constant cross-section duct cannot minimise the impedance mis-match or the magnitude of the reflected sound. The characteristic impedance requirement, to have zero real part at low frequencies and a negative imaginary part, means that the duct necessarily must have a cross sectional area that reduces as the wave propagates from the diaphragm to the metamaterial absorber.

Accordingly, the acoustic impedance of the acoustic metamaterial absorber may substantially match the characteristic acoustic impedance of acoustic waves radiated from the rear surface of the diaphragm at the point they contact the surface of the acoustic metamaterial absorber.

The front surface of the acoustic metamaterial absorber (or the virtual front surface, see below) may be located at the opening at the rearward end of the or each open duct. Preferably the metamaterial behind the opening at the rearward end of the or each open duct has a size perpendicular to the front-rear direction, greater than the size of the opening at the rearward end of the or each open duct. Such an arrangement allows the channels of the metamaterial which dissipate acoustic energy to have a radial alignment, so that the metamaterial can spread out from the central axis of the loudspeaker. Accordingly, the length of the metamaterial in the front-rear direction can be less than its size perpendicular to the front-rear direction; this allows the metamaterial to be in the form of a thin block or sheet, so as to be able to minimise the axial length of the loudspeaker. The cross-sectional area of the or each open duct may taper or decrease linearly in a rearward direction to the opening at its rearward end; in such cases, the duct leading forwardly from the opening at the rear end of the duct can be conically tapered (as defined below).

The acoustic metamaterial may be partially contained within the or each duct, or the or each open duct may have an opening at its rearward end, the front surface of the acoustic metamaterial absorber being located at this opening. Such arrangements effectively move the metamaterial absorber away from the rear of the diaphragm, so that the metamaterial is located behind the drive unit where there is more space and freeing up room immediately behind the diaphragm for other loudspeaker elements.

The drive unit and the at least one open duct may be located to the rear of the diaphragm and the at least one open duct may extend through the drive unit in a rearward direction, away from the diaphragm, with the front surface of the acoustic metamaterial absorber being located generally to the rear of the drive unit. Alternatively, the drive unit may be located outside and/or forwardly of the diaphragm; in this case, the open duct would not pass though the drive unit but would still extend rearwardly of the diaphragm, and the metamaterial would be located at or adjacent the rearward end of the duct.

The or each open duct preferably tapers conically towards the front surface of the acoustic metamaterial absorber, in a right or oblique cone. Additionally or alternatively the or each open duct might have walls which taper inwardly in a curve towards the front surface of the acoustic metamaterial absorber. The or each duct may comprise walls which taper conically, and taper inwardly in a curve, in successive sections. Where the walls taper inwardly in a curve, the walls continue to define a conic taper because the cross-sectional area of the duct preferably reduces in size linearly in the direction of the metamaterial absorber. There may be a plurality of open ducts, and each duct may lead to a separate acoustic metamaterial absorber. The plurality of open ducts can be arranged in a matrix or in a ring and/or, where the plurality of open ducts is arranged in a ring, the ring can be circular. The or each open duct may have a constant cross-sectional shape, which may be circular. it is preferred that the or each open duct does not contain sound absorbent material (although in some applications such material may have benefits). The diaphragm can be a dome or conical diaphragm; in the latter case the duct(s) is/are preferably located outside of the tweeter drive unit and behind the diaphragm in an annular or ring-like arrangement.

In another aspect, the invention also provides a method of designing a loudspeaker as described above in which one or more of the length, one or both end areas, the resonance frequency and the resonant strengths of the or each open duct are adjusted so as to allow the acoustic impedance of the acoustic metamaterial absorber substantially to match the characteristic acoustic impedance of acoustic waves radiated from the rear surface of the diaphragm at the point they contact the surface of the acoustic metamaterial absorber.

BRIEF DESCRIPTION OF THE DRAWINGS

The invention will now be described by way of example and with reference to the accompanying figures, in which.

DETAILED DESCRIPTION OF THE EMBODIMENTS

Figure 1A:
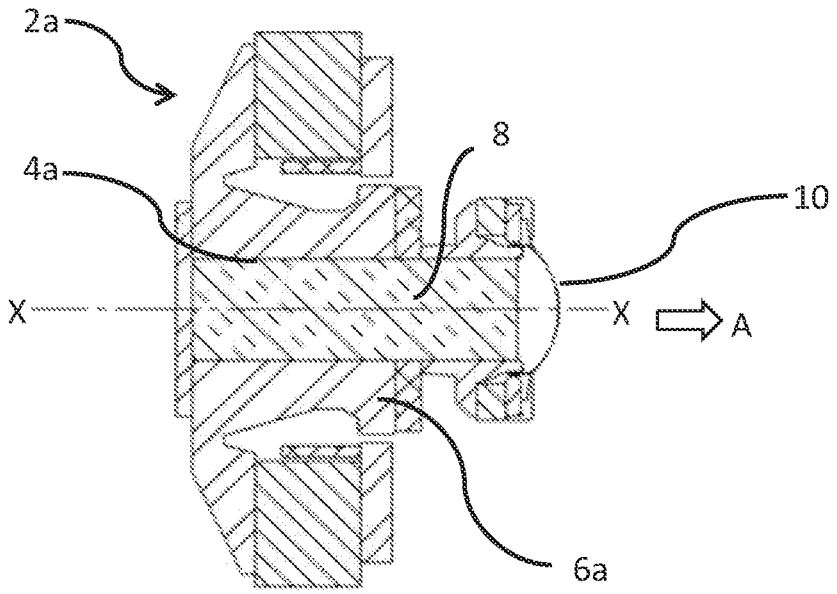
Fig 1a Prior Art
FIGS. 1*a* and 1*b* show in cross-section prior art high frequency drivers from coaxial drivers.
Figure 1B:
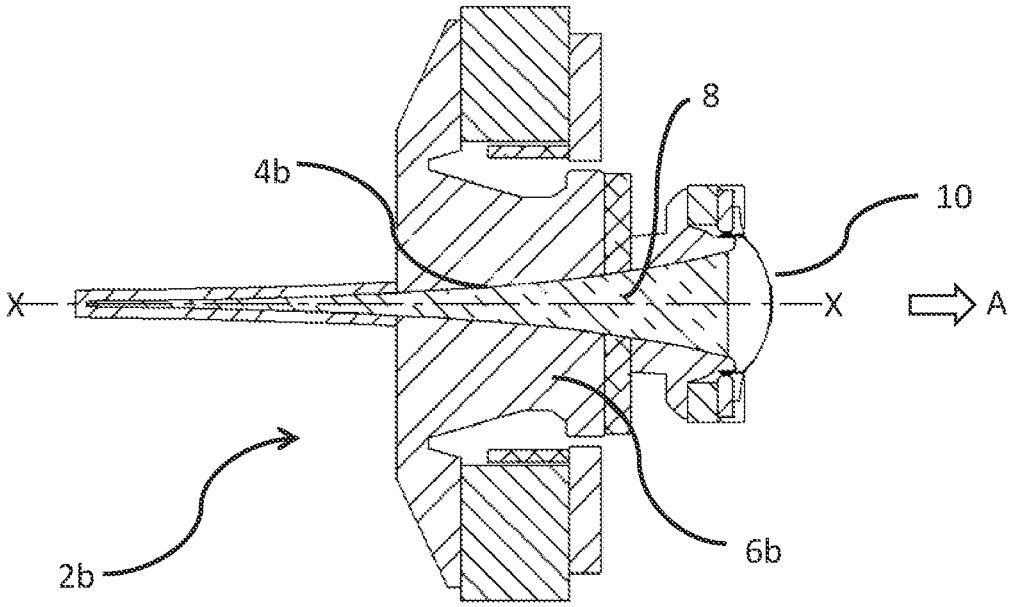

FIG. 1*a* shows a high-frequency driver with a 25.4 mm diameter diaphragm using a large central vent tube/duct filled with dense acoustical wadding. FIG. 1*b* shows a high-frequency driver with a 25.4 mm diameter diaphragm using a 120 mm long, exponentially tapering duct which is also filled with dense acoustical wadding.

Figure 2:
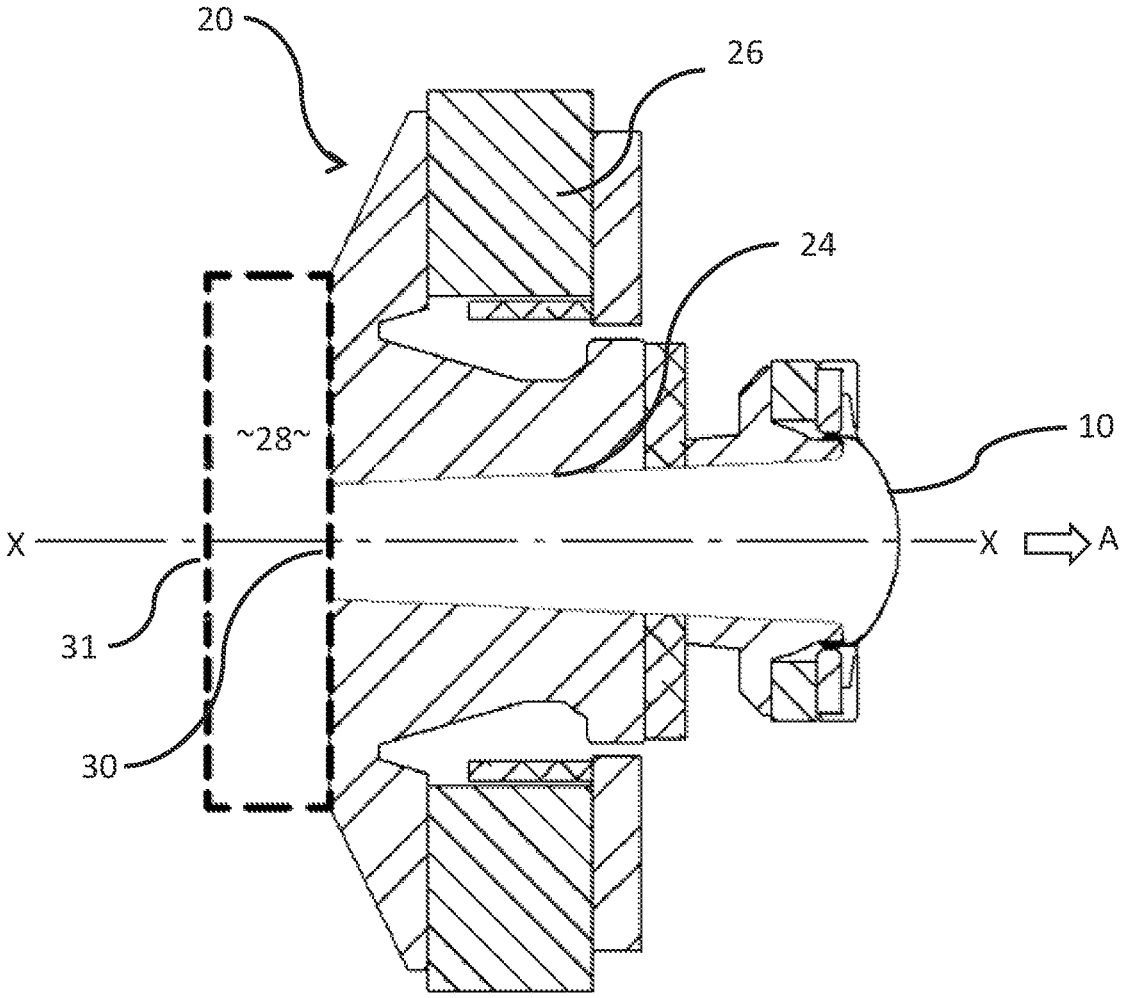
FIG. 2 shows an embodiment of a loudspeaker arrangement in accordance with the invention.

FIG. 2 shows in cross-section a tweeter 20 forming part of a coaxial driver with a highly effective arrangement according to this invention. The conical duct 24 through the drive unit 26 connecting the 25.4 mm diameter diaphragm 10 to the front surface 30 of the acoustic metamaterial 28 results in a spherical contracting acoustical wave with radius 146.4 mm at the front surface 30 of the metamaterial 28. The characteristic acoustical impedance of this wave is a close match to the impedance of the metamaterial described in WO 2018/047153 when a design frequency of 600 Hz is used. The impedance match in this case is not perfect and only over a limited bandwidth but it is enough that the reflection issue is almost totally solved to the extent that it is not a limiting factor in the tweeter performance.

A tapering duct is also very practical for a number of reasons:

1. Commonly dome-shaped diaphragms are used on high-frequency units and the concave side tends to radiate the rear wave. This type of diaphragm can be made to generate a close to ideal spherical wave over a wide bandwidth when connected to an appropriate tapering duct (see for example U.S. Pat. No. 8,094,854B2)
2. The required entrance area of the metamaterial absorber is reduced by the tapered duct and this reduces the size of the metamaterial absorber fairly substantially.
3. The tapered duct occupies less space than a straight duct and makes it easier to accommodate this into a loudspeaker design where other parts are competing for space.

A conical duct is a good choice since it carries a spherical acoustic wave in a single parameter fashion, and consequently there is no diffraction and minimal reflection as the wave propagates in the duct. Other tapered ducts with curved walls could equally be used and provided the radius of the acoustical wave where the duct joins the metamaterial is correct an impedance miss-match could be largely avoided; this can be achieved by ensuring that the cross-sectional area of the duct decreases linearly in the direction of the metamaterial, particularly as the duct approaches the front surface of the metamaterial. In some cases such an arrangement may give preferable results or a more practical geometry; for example, the part of the duct immediately behind the diaphragm could be enlarged so as to provide an acoustic volume before the duct begins to taper.

FIG. 2 shows that the metamaterial 28 not only extends axially in a rearward direction (to the left as shown) behind the duct 24, but also that it extends radially from the XX axis to a substantially greater extent than the radius of the conical duct 24. For the metamaterial 28 shown to be most effective, the narrow acoustic channels (not shown) forming the metamaterial have at least a part of their lengths oriented radially (or with a substantially radial component); this allows the axial dimensions of the loudspeaker to be kept small. As in WO 2018/047153, the radial parts of the channels may be folded, so as to incorporate channels of greater overall length within a short axial distance.

The metamaterial 28 is shown as having a front surface 30 which extends across the open rear end of the duct 24; this front surface may be formed by the ends of the structural walls which form the narrow channels, so that there is a physical, albeit discontinuous, surface extending across the open end of the duct 24. Alternatively, and so as to facilitate the directing of acoustic waves along radially-directed channels, there may be a concavity, or "interface volume", (i.e. an empty volume—not shown, but extending to the left of the right hand broken vertical line in the drawing) at the front of the metamaterial where it meets the rear end of the open duct 24; the inner surface of this interface volume is shaped to have at least a part facing outwardly radially or substantially radially so as to direct acoustic waves in or approaching a radial direction. The interface volume could for example, be part spherical, domed or even cylindrical (provided that there is always at least a solid rear boundary 31 to the metamaterial 28 (at the left hand broken vertical line in the drawing); the significant design element of this interface volume is that its impedance matches the end of the conical duct. Accordingly, it should be understood that reference herein to the "front surface" of the metamaterial embraces not only cases where there is a physical albeit discontinuous surface of metamaterial structure extending radially across the open rear end of the duct 24, but also where there is only a virtual surface extending radially across the open rear end of the duct 24 (i.e. where there is an interface volume within that part of the metamaterial immediately adjacent the open rear end of the duct 24). Where there is such an interface volume and only a virtual front surface to the metamaterial adjacent the duct, the front surface of the metamaterial outside the interface volume/the open rear end of the duct seals against the rear structure of the tweeter 20 as shown to prevent acoustic energy from travelling other than through the narrow channels—to be dissipated therein.

Figure 3:
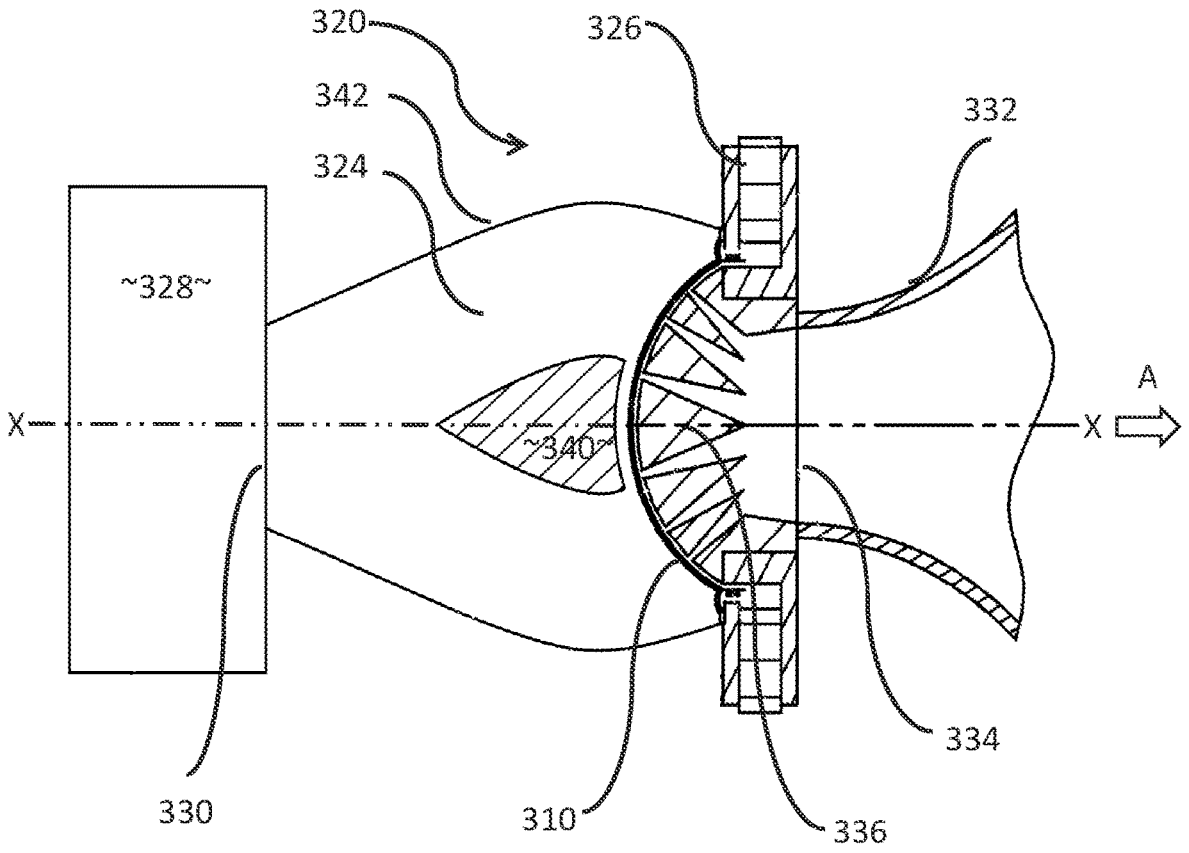
FIG. 3 shows a schematic view in cross-section of another loudspeaker arrangement in accordance with the invention.

In FIG. 3 an alternative loudspeaker arrangement 320 is shown which is in accordance with the invention, in which the drive unit 326 is located forwardly and radially outside the diaphragm 310. The diaphragm 310 is curved in the opposite direction to that shown in FIG. 2, so that its concave surface radiates sound in the direction of arrow A towards the listener, this sound passing through passages in a phase plug 336, leaving the driver opening 334 and passing through acoustic horn 332. In this arrangement, the duct 324 extending rearwardly of the diaphragm 310 is initially curved in profile, and initially it enlarges in cross-sectional area, before curving inwardly and tapering towards the metamaterial 328, the front surface of which 330 is located at the end of the duct 324. There is a plug 340 located inside the duct 324 and having an outer profile which is curved so as to interact with the curved walls 342 of the duct 324 so that the cross-sectional area of the open part of the duct (i.e. the area between the walls 342 and the plug 340) decreases linearly along the XX axis (and the duct in the axial distance between the plug 340 and the front surface 330 of the metamaterial 328 is conical); this arrangement means that the open duct 324 shown in FIG. 3 is effectively "conical" along most of its axial length.

As in the arrangement of FIG. 2, in FIG. 3 the metamaterial 328 has narrow acoustic channels (not shown) forming the metamaterial which have at least a part of their lengths oriented radially (or with a substantially radial component), and/or they may comprise an interface volume as described above.

It will of course be understood that many variations may be made to the above-described embodiment without departing from the scope of the present invention. For example, the embodiment above is described as having one or more circular, conical ducts; however, the invention applies equally to non-circular arrangements, such as oval, elliptical or race track shaped (figure of eight, or triangular/square/polygonal with rounded corners), or any shape being symmetrical in one or two orthogonal directions lying in the general plane perpendicular to the front-rear axis A, as well as combinations of such arrangements and/or shapes. The duct(s) may be conical, with straight walls, or the walls may be curved (e.g. exponentially, elliptical, hyperbolic or parabolic). Conical ducts may be right cones or oblique cones. There may be an annular arrangement of several ducts, which may be parallel, or arranged as a tapering or an enlarging right cone or oblique cone. Where several ducts are provided, there may be separate and/or different acoustic metamaterials provided at the rear end of each different duct. The metamaterial could intrude into a duct, such that the front surface of the metamaterial extends forwardly inside the duct, a short distance forward of its rearward end; this might be for acoustic reasons, or to help accurately locate the metamaterial relative to the duct (such as where there are multiple ducts, the metamaterial might be shaped with protrusions to engage with the rearward ends of some or all of the ducts. Different types of metamaterials may be combined in an embodiment, and the multiple elements forming the metamaterial may repeat or they may be different in shape, dimension or structure. In the drawn embodiment of FIG. 2 there is an empty volume between the rear of the diaphragm 10 and the front surface of the metamaterial; this volume is formed from the volume of the conical duct 24 through the drive unit 26 and from the acoustic volume behind the diaphragm 10. In some embodiments it might be beneficial to enlarge the size of the empty volume, such as by increasing the size of the volume behind the diaphragm, and/or by enlarging the initial part of the tapering duct, as in FIG. 3. It may be that the initial part of the duct, immediately behind the diaphragm, increases in cross-sectional area for a short rearward direction before the duct reduces in cross-sectional area for the remainder of the rearward direction towards the metamaterial. The or each tapering duct may comprise portions which taper conically in combination with portions which taper in a curved profile, provided that the tapering of the duct in the vicinity of the front surface of the metamaterial is conical as described above.

Where different variations or alternative arrangements are described above, it should be understood that embodiments of the invention may incorporate such variations and/or alternatives in any suitable combination.

The invention claimed is:

1. A loudspeaker comprising:

i. an acoustic diaphragm having front and rear surfaces, the acoustic diaphragm in use being driven so as to vibrate and radiate acoustic waves from its front surface in a forward direction away from the loudspeaker and from its rear surface in a rearward direction, and ii. a drive unit, and iii. at least one open duct leading through the drive unit in a rearward direction away from the diaphragm and having an opening at its rearward end, in which the at least one open duct has a cross-sectional area extending in the rearward direction, in which the cross-sectional area decreases along at least part of the rearward direction, and in which acoustic waves radiated from the rear surface of the diaphragm pass through substantially all of the open duct before contacting a front surface of an acoustic metamaterial absorber located generally outside and to the rear of the duct, and immediately to the rear of the decreasing cross-sectional area, and in which at least a part of the or each open duct tapers conically towards the front surface of the acoustic metamaterial absorber.

2. The loudspeaker according to claim 1 in which the front surface of the acoustic metamaterial absorber is located at the opening at the rearward end of the or each open duct.

3. The loudspeaker according to claim 1 in which the metamaterial behind the opening at the rearward end of the or each open duct has a size perpendicular to the front-rear direction, greater than the size of the opening at the rearward end of the or each open duct.

4. The loudspeaker according to claim 1, wherein the length of the metamaterial in the front-rear direction is less than its size perpendicular to the front-rear direction.

5. The loudspeaker according to claim 1 in which the metamaterial comprises a plurality of narrow channels adapted to dissipate acoustic energy, and in which at least a part of each channel perpendicularly away from the opening at the rearward end of the or each open duct is aligned perpendicularly to the front-rear direction.

6. The loudspeaker according to claim 1 in which the cross-sectional area of the or each open duct tapers or decreases linearly in a rearward direction to the opening at its rearward end.

7. The loudspeaker according to claim 1 in which the drive unit and the at least one open duct extend in a rearward direction, away from the diaphragm, the front surface of the acoustic metamaterial absorber being located generally to the rear of the drive unit.

8. The loudspeaker according to claim 1 in which the acoustic impedance of the acoustic metamaterial absorber substantially matches the characteristic acoustic impedance of acoustic waves radiated from the rear surface of the diaphragm at the point they contact the surface of the acoustic metamaterial absorber.

9. The loudspeaker according to claim 1 in which at least a part of the or each open duct has walls which taper inwardly in a curve towards the front surface of the acoustic metamaterial absorber.

10. The loudspeaker according to claim 1 comprising a plurality of open ducts, in which each duct leads to a separate acoustic metamaterial absorber.

11. The loudspeaker according to claim 1 in which the or each open duct has a constant cross-sectional shape.

12. The loudspeaker according to claim 1 in which the at least one open duct comprises an annular duct.

13. The loudspeaker according to claim 1 in which the or each open duct contains sound absorbent material.

14. A method of designing a loudspeaker comprising an acoustic diaphragm having front and rear surfaces, the acoustic diaphragm in use being driven so as to vibrate and radiate acoustic waves from its front surface in a forward direction away from the loudspeaker and from its rear surface in a rearward direction, a drive unit, and at least one open duct leading through the drive unit in a rearward direction away from the diaphragm and having an opening at its rearward end in which the at least one open duct has a cross-sectional area extending in the rearward direction, in which the cross-sectional area decreases conically along at least part of the rearward direction, and in which acoustic waves radiated from the rear surface of the diaphragm pass through substantially all of the open duct before contacting a front surface of an acoustic metamaterial absorber located generally outside and to the rear of the duct, and immediately to the rear of the decreasing cross-sectional area in which one or more of the length, one or both end areas, the resonance frequency and the resonant strengths of the or each open duct are adjusted so as to allow the acoustic impedance of the acoustic metamaterial absorber substantially to match the characteristic acoustic impedance of acoustic waves radiated from the rear surface of the diaphragm at the point they contact the surface of the acoustic metamaterial absorber.

* * * * *